US008824913B2

(12) United States Patent
Makino

(10) Patent No.: US 8,824,913 B2
(45) Date of Patent: Sep. 2, 2014

(54) IMAGE FORMATION DEVICE

(75) Inventor: Masato Makino, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 746 days.

(21) Appl. No.: 13/070,141

(22) Filed: Mar. 23, 2011

(65) Prior Publication Data

US 2011/0274457 A1 Nov. 10, 2011

(30) Foreign Application Priority Data

May 10, 2010 (JP) ..... 2010-108271

(51) Int. Cl.
*G03G 15/00* (2006.01)
*G03G 15/16* (2006.01)
*G03G 21/00* (2006.01)

(52) U.S. Cl.
USPC ..... 399/90; 399/101; 399/357

(58) Field of Classification Search
USPC ..... 399/90, 101, 357
See application file for complete search history.

(56) References Cited

U.S. PATENT DOCUMENTS 5,515,146 A * 5/1996 Harasawa et al. ..... 399/310
5,600,405 A * 2/1997 Umeda et al. ..... 399/71
6,269,228 B1 * 7/2001 Kayahara et al. ..... 399/37
6,704,535 B2 * 3/2004 Kobayashi et al. ..... 399/308
6,879,801 B2 * 4/2005 Soda et al. ..... 399/302
7,627,263 B2 * 12/2009 Takishita ..... 399/101
7,787,800 B2 * 8/2010 Mori ..... 399/101
7,796,911 B2 * 9/2010 Kato et al. ..... 399/99
7,945,202 B2 * 5/2011 Kimura et al. ..... 399/353
2002/0034405 A1 * 3/2002 Kayahara et al. ..... 399/297
2003/0118378 A1 * 6/2003 Kayahara et al. ..... 399/297
2003/0123911 A1 * 7/2003 Kayahara et al. ..... 399/297
2003/0215269 A1 * 11/2003 Kayahara et al. ..... 399/297
2005/0019049 A1 * 1/2005 Shin ..... 399/66
2006/0056885 A1 * 3/2006 Takiguchi et al. ..... 399/310
2006/0171735 A1 * 8/2006 Hamada et al. ..... 399/101
2006/0210300 A1 * 9/2006 Nishikawa ..... 399/101
2007/0036578 A1 * 2/2007 Fukami et al. ..... 399/101
2007/0059027 A1 * 3/2007 Ishikawa et al. ..... 399/101
2007/0147903 A1 * 6/2007 Mori ..... 399/264
2007/0230993 A1 * 10/2007 Takeuchi ..... 399/101
2007/0286621 A1 * 12/2007 Nishikawa ..... 399/49

(Continued)

FOREIGN PATENT DOCUMENTS

JP 06-258957 A 9/1994
JP 2005-308894 A 11/2005
JP 2008-046407 A 2/2008

*Primary Examiner* — David Bolduc
(74) *Attorney, Agent, or Firm* — Banner & Witcoff, Ltd.

(57) ABSTRACT

An electrophotographic image formation device configured to form images on a recording sheet is provided with a belt unit having an endless belt wound around a first roller and a second roller, a cleaning unit facing the endless belt and collects particles adhered on the endless belt with use of an electrostatic attractive force, a first voltage being applied to the cleaning unit, a backup unit arranged to face the cleaning unit with the endless belt being located therebetween, a second voltage that is different from the first voltage being applied to the backup unit, an electric wiring unit provided to the belt unit and electrically connected with the backup unit, and an electric current detection unit configured to detect an current value of an electric current flowing through the electric wiring unit. The electric wiring unit is electrically independent from other electric wiring units provided to the belt unit.

7 Claims, 6 Drawing Sheets

(56) References Cited

U.S. PATENT DOCUMENTS

2008/0019723 A1* 1/2008 Naganawa et al. ..... 399/71
2008/0044193 A1 2/2008 Mori
2008/0273891 A1* 11/2008 Hamada et al. ..... 399/71
2010/0111557 A1* 5/2010 Maruyama ..... 399/71
2011/0103822 A1* 5/2011 Sugiura et al. ..... 399/101
2012/0224870 A1* 9/2012 Kikuchi et al. ..... 399/44

* cited by examiner

IMAGE FORMATION DEVICE

CROSS-REFERENCE TO RELATED APPLICATION

This application claims priority under 35 U.S.C. §119 from Japanese Patent Application No. 2010-108271 filed on May 10, 2010. The entire subject matter of the application is incorporated herein by reference.

BACKGROUND

1. Technical Field

Aspects of the present invention relate to an electrophotographic image formation device.

2. Related Art

An electrophotographic image formation device typically employs endless belts for a transfer belt and/or a sheet feed belt. In such an image formation device, if an image formation process is executed with particles such as toner being adhered onto the endless belt, quality of the formed images may deteriorate.

In order to remove such particles from the endless belt, there has been know a technique in which a cleaning roller and a backup roller are arranged to face each other with the endless belt therebetween, and a voltage is applied between the cleaning roller and the backup roller so that the cleaning roller has an electro-static attracting force for attracting such particles.

Further, as the endless belt moves, the endless belt itself and a pair of rollers on which the endless belt is wound may be charged (i.e., electric charge is accumulated). If a high voltage is generated by the thus accumulated charge, which may have bad effect on the image formation process. To deal with such a problem, in the conventional art, the pair of rollers is discharged with use of a discharge circuit electrically connected to the pair of rollers.

SUMMARY

If a discharge occurs between the cleaning roller and the backup roller and an excess current flows therebetween, the endless belt nipped therebetween may deteriorate earlier. That is, when charged particles on the endless belt are collected by the cleaning roller, an electric current corresponding to the charges of the collected particles flows between the cleaning roller and the backup roller. If the discharge occurs, the electric current exceeding the charges of the collected particles flows between the cleaning roller and the backup roller.

In the electrophotographic image formation device configured to collect the particles adhered onto the endless belts with use of the electrostatic attracting force, the current value of the electric current flowing through the electric circuit electrically connected to the backup roller is checked and the voltage applied between the cleaning roller and the backup roller is controlled to prevent the excess current therebetween.

In the conventional art, however, a part of the electric circuit electrically connected to the backup roller serves as at least a part of the discharge circuit. Therefore, the current flowing in the discharge circuit may have influence on accurate detection of the electric current flowing through the electric circuit electrically connected to the backup roller.

Because of the above, in the conventional art, the voltage applied between the cleaning roller and the backup roller may not be controlled accurately, and therefore, the endless belts may not be prevented from deteriorating effectively. It should be noted that the above-described problem of deterioration of the endless belts may occur not only in an image formation device employing a direct method (i.e., a method of directly transferring a toner image on a recording sheet fed by the endless belt) but also an image formation device employing an intermediate transfer method (i.e., a method of transferring a toner image to an endless belt, and then the transferring the toner image from the endless belt to the recording sheet).

In view of the above, aspects of the invention provide an improved image formation device in which current value of the electric current flowing through the electric circuit connected to the backup roller or the like can be detected accurately.

According to aspects of the invention, there is provided an electrophotographic image formation device, which configured to form images on a recording sheet and is provided with a belt unit having an endless belt wound around a first roller and a second roller, a cleaning unit facing the endless belt and collects particles adhered on the endless belt with use of an electrostatic attractive force, a first voltage being applied to the cleaning unit, a backup unit arranged to face the cleaning unit with the endless belt being located therebetween, a second voltage that is different from the first voltage being applied to the backup unit, an electric wiring unit provided to the belt unit and electrically connected with the backup unit, and an electric current detection unit configured to detect an current value of an electric current flowing through the electric wiring unit. The electric wiring unit is electrically independent from other electric wiring units provided to the belt unit.

BRIEF DESCRIPTION OF THE ACCOMPANYING DRAWINGS

DETAILED DESCRIPTION

Figure 1:
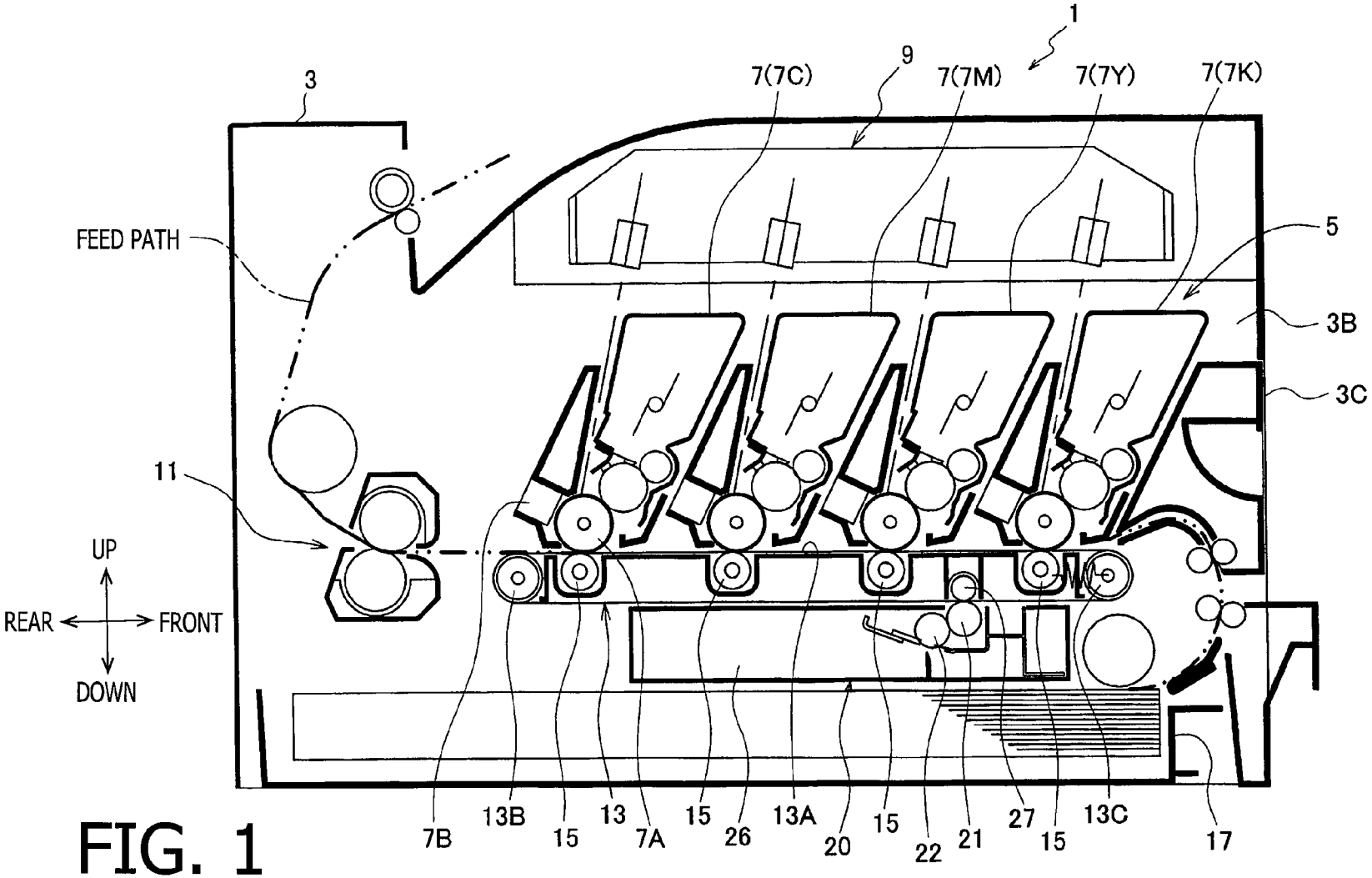
FIG. 1 is a cross-sectional side view schematically showing a structure of an image formation device according to an embodiment of the invention.

Hereinafter, an exemplary embodiment according to aspects of the present invention will be described with reference to the accompany drawings. In the following description, as an example, a direct tandem color image formation device will be described.

In a housing 3 of an image formation device 1, an electrophotographic image formation unit 5, which forms an image on recording medium such as recording sheets or OHP sheets (hereinafter, referred to as sheets) by transferring toner images on the sheets. The image formation unit 5 includes a process cartridge 7, an exposure unit 9 and a fixing unit 11.

According to the embodiment, the image formation device 1 is a direct tandem type image formation device, which includes a plurality of (cf. four, in the embodiment) process cartridges 7K-7C which are arranged in a direction where the sheet is fed. Each of the process cartridges 7K, 7M, 7Y and 7C has a photoconductive drum 7A on which a toner image is formed, and a charging unit 7B which charges the circumferential surface of the photoconductive drum 7A. It should be noted that, in FIG. 1, only the photoconductive drum 7A and the charging unit 7B of the process cartridge 7C are indicated for brevity, but the process cartridges 7K-7C have the same structure.

The charged photoconductive drum 7A is exposed to light emitted by the exposure unit 9 and an electrostatic latent image is formed on the circumferential surface of the photoconductive drum 7A. Then, charged developer (toner) is supplied to the photoconductive drum 7A, toner is selectively attracted on the circumferential surface of the photoconductive drum 7A and a toner image is formed thereon.

According to the embodiment, the developer (toner) is positively charged. The portion of the circumferential surface of the photoconductive drum 7A exposed to the light emitted by the exposure unit 9 (i.e., the portion of the latent image) has a lower voltage, while the other portion retains the voltage as charged by the charging unit 7B (i.e., the other portion has a higher voltage).

The developer (i.e., toner) is charged to have an intermediate voltage between that of the latent image (i.e., the low potential) and that of the other portion of the photoconductive drum 7A (i.e., the high potential). Therefore, the charged developer is attracted by the latent image, and thus the developed image (i.e., the toner image) is formed on the circumferential surface of the photoconductive drum 7A.

At positions facing respective photoconductive drums 7A with a transfer belt 13A located therebetween, transfer rollers 15 that cause the developer carried by the photoconductive drums 7A to transfer onto the sheet are arranged. The transfer rollers 15 are arranged along a sheet feed direction, or the moving direction of the transfer belt 13A within a space surrounded by the transfer belt 13A.

To each transfer roller 15, a voltage that causes the electrostatic attractive force between the transfer roller 15 and the developer carried on the photoconductive drum 7A is applied. For example, a voltage having an opposite polarity with respect to the electric charge of the developer (i.e., negative voltage in this embodiment) is applied.

Then, the developer carried by each photoconductive drum 7A is moved toward the corresponding transfer roller 15, and transferred onto the sheet fed by the transfer belt 13A. Thereafter, the sheet bearing the developed image (i.e., toner image) is fed to the fixing unit 11, where the developed image on the sheet is fused and fixed onto the sheet.

Figure 2:
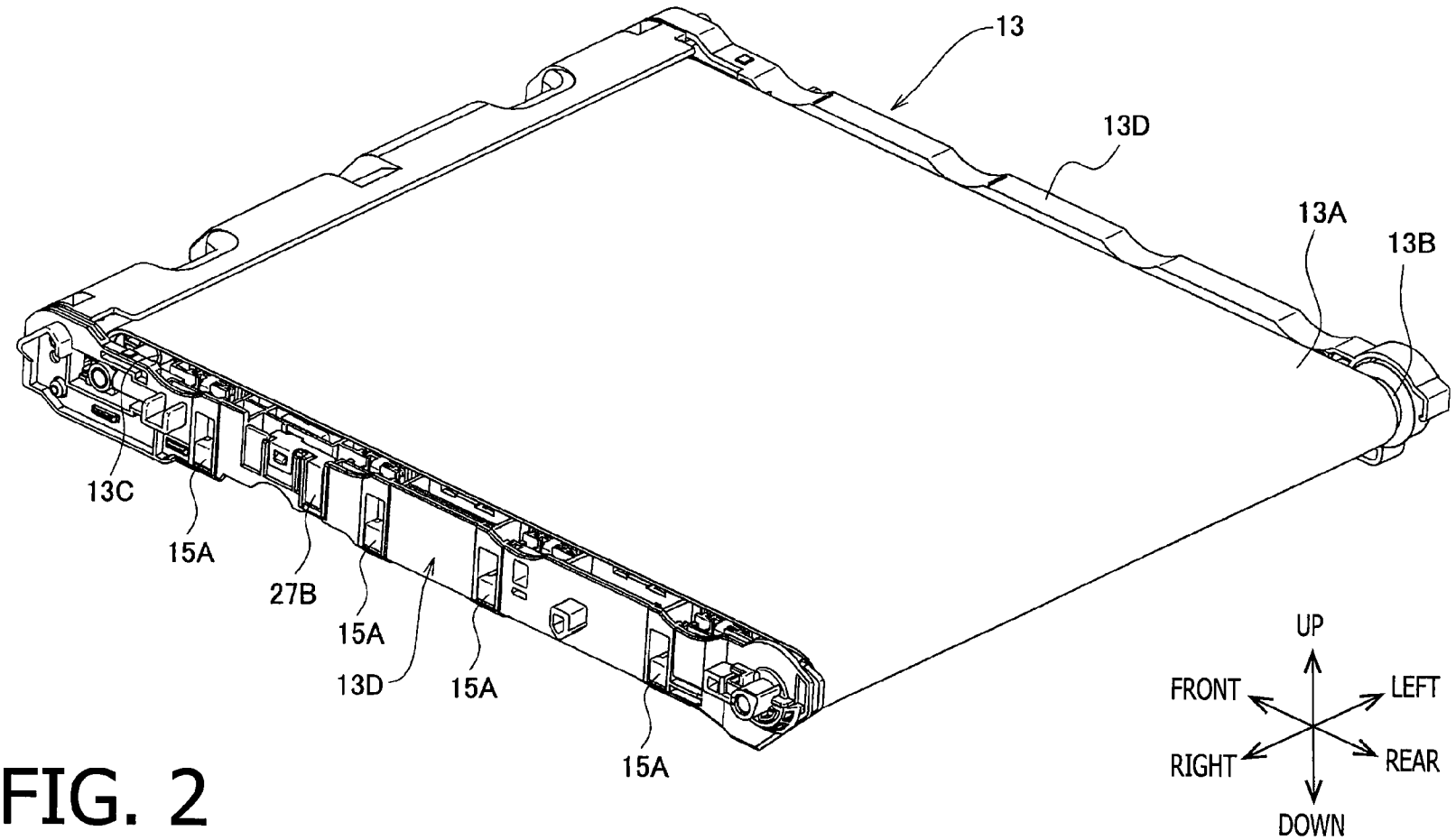
FIG. 2 is a perspective view of a belt unit of the image formation device shown in FIG. 1.
Figure 3:
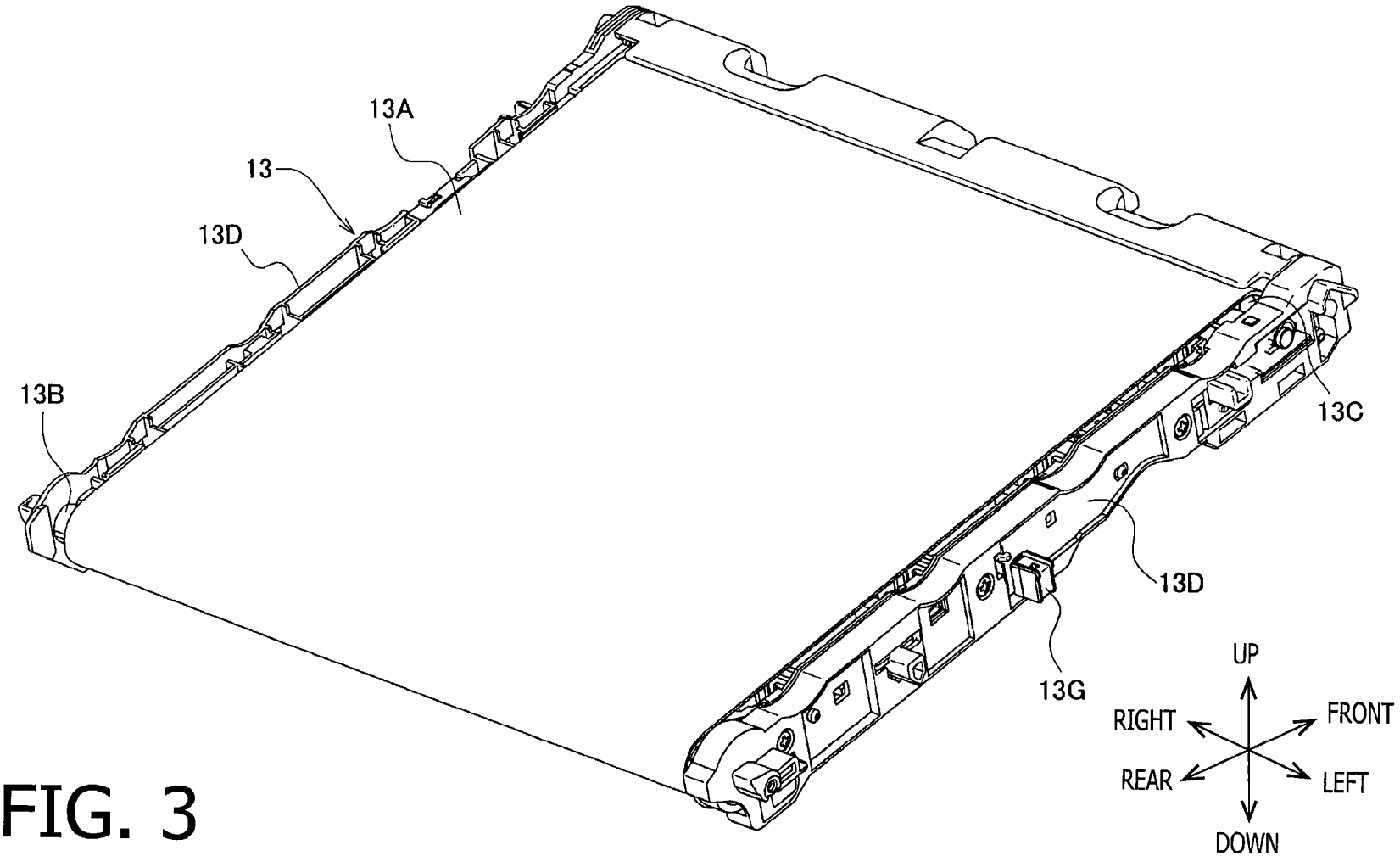
FIG. 3 is a perspective view of the belt unit of the image formation device shown in FIG. 1.

The transfer belt 13A is an endless belt wound around a driving roller 13B and a driven roller 13C and tensioned therebetween. The axial ends of the driving roller 13B, driven roller 13C and the plurality of transfer rollers 15 are supported by a frame 13D (see FIGS. 2 and 3).

The transfer belt 13A, the rollers 13B, 13C and 15 are integrated by means of the frame 13D to form a belt unit 13. The belt unit 13 is detachably attached to the main body.

According to the embodiment, on a front surface of the main body (housing 3), an opening 3B and a front cover 3C for closing/exposing the opening 3B are provided (see FIG. 1). By turning down the front cover 3C in the front direction, the image formation unit 5 can be removed through the opening 3B. Then, through the opening 3B, the belt unit 13 can also be removed from the main body.

In this specification, the main body means a component such as a main frame 3A (see FIG. 5) and the housing 3 which is not usually disintegrated.

Below the belt unit 13, as shown in FIG. 1, a sheet feed tray 17 is provided. The sheet feed tray 17 supplies the sheets to be fed toward the image formation unit 5. The sheet feed tray 17 is also detachable from the main body.

Between the belt unit 13 and the sheet feed tray 17, a belt cleaner unit 19 of a belt cleaner 20 is detachably attached to the main body.

The belt cleaner 20 is a device configured to remove the particles (e.g., toner) adhered onto the surface of the transfer belt 13A. The belt cleaner unit 19 is arranged on an opposite side with respect to the process cartridge 7 with the transfer belt 13A therebetween.

Figure 4:
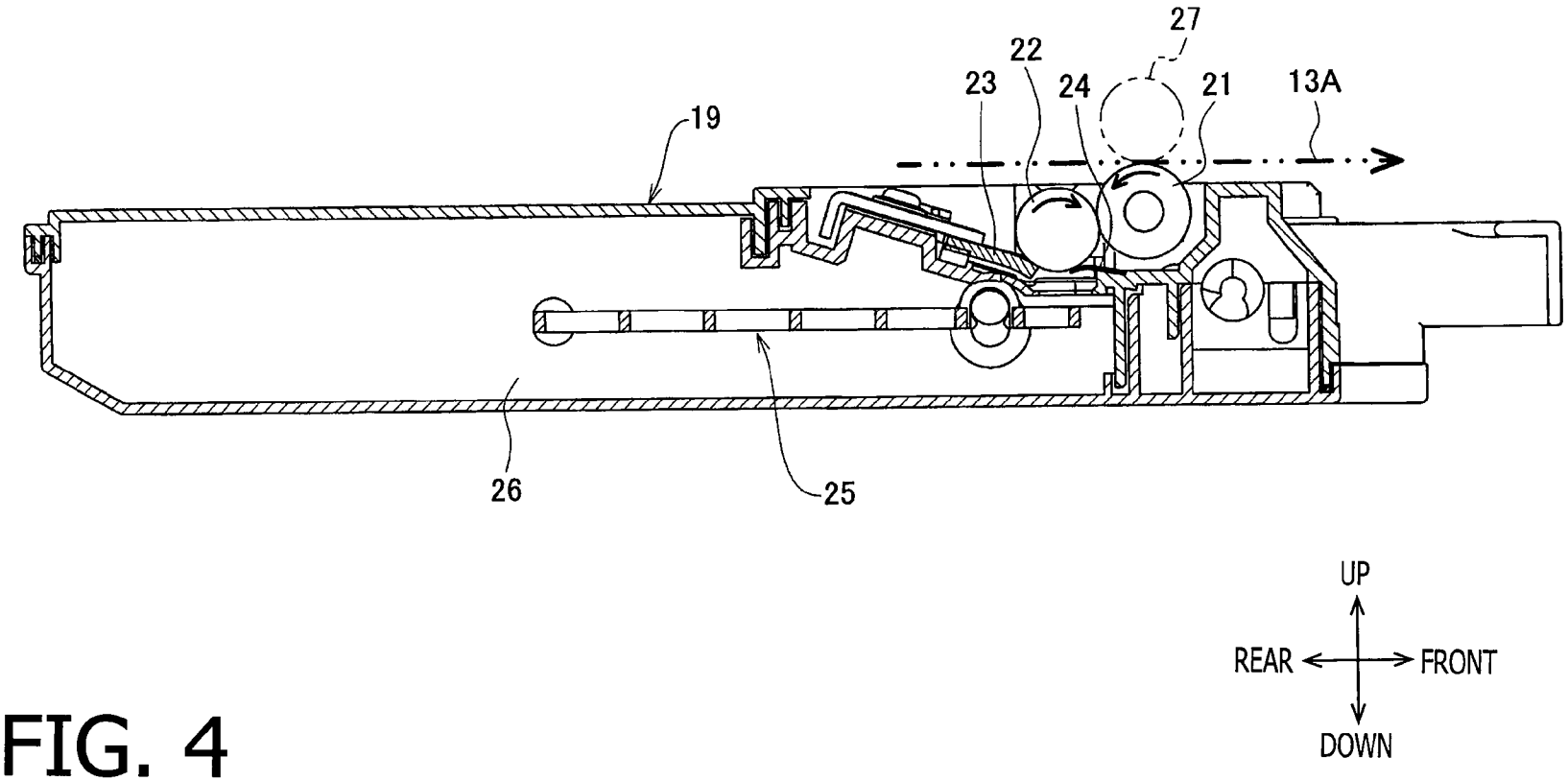
FIG. 4 is a cross-sectional side view schematically showing a structure of a belt cleaner of the image formation device shown in FIG. 1.

The belt cleaner 20 includes the belt cleaner unit 19 and an apply voltage control circuit 30 (see FIG. 6), and the like. The belt cleaner unit 19 is provided with, as shown in FIG. 4, a cleaning roller 21, a cleaning shaft 22, a peeling blade 23, a shatterproof blade 24 and an agitator 25.

The cleaning roller 21 is arranged to face the transfer belt 13A to collect the particles (e.g., developer) adhered on the surface of the transfer belt 13A. The cleaning shaft 22 is for collecting the developer adhered on the surface of the cleaning roller 21 and transfer the collected developer to a developer accommodation unit 26.

At a position opposite to the cleaning roller 21 with the transfer belt 13A therebetween, a backup roller 27 which urges the transfer belt 13A to the cleaning roller 21 is provided.

Between the cleaning roller 21 and the backup roller 27, and between the cleaning roller 21 and the cleaning shaft 22, a voltage which causes an electrostatic attractive force with respect to the developer is applied.

That is, according to the embodiment, since the developer is positively charged, backup roller 27 is grounded (i.e., set to zero volt) and a voltage having an opposite polarity to the voltage of the developer (i.e., a negative voltage) is applied to the cleaning roller 21 and the cleaning shaft 22.

With the above configuration, by the electrostatic attractive force between the cleaning roller 21 and the developer, the developer adhered on the transfer belt 13A is attracted by the cleaning roller 22, and thus cleaned.

At this stage, the absolute value of the voltage applied to the cleaning shaft 22 is greater than the absolute value of the voltage applied to the cleaning roller 21, the developer adhered on the cleaning roller 21 is transferred to the cleaning shaft 22 by the electrostatic attractive force, thereby the developer being collected from the cleaning roller 21.

Incidentally, according to the embodiment, the voltage applied to the cleaning roller 21 is approximately −1800 V, and the voltage applied to the cleaning shaft 22 is approximately −1400 V.

The developer collected onto the surface of the cleaning shaft 22 is scraped with the peeling blade 23 having a thin-plate shape. The shatterproof blade 24 prevent the scraped developer from shattering toward the cleaning roller 21, and the scraped developer is transferred to the developer container 26 by the agitator 25.

Incidentally, the surface of the cleaning roller 21 is formed with elastic porous material such as urethane rubber, while the surface of the cleaning shaft 22 and the surface of the backup roller 27 is formed with rigid material (e.g., metal).

Figure 5:
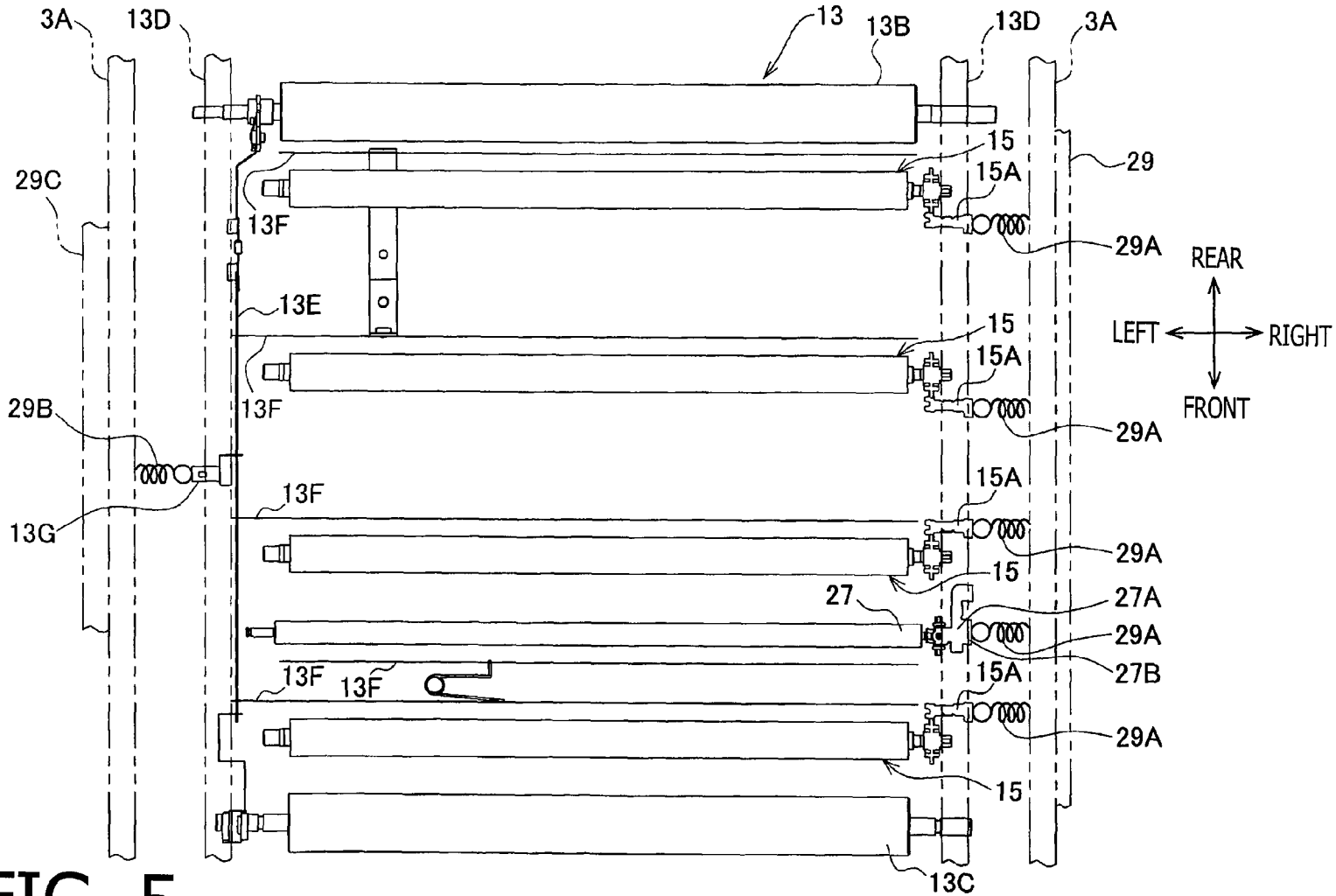
FIG. 5 is an explanatory diagram showing wiring units installed in the belt unit of the image formation device shown in FIG. 1.

The backup roller 27 is rotatably secured to the belt unit 13 (i.e., frame 13D), and an electric wiring unit 27A which connects the backup roller 27 to ground is provided to the belt unit 13 (see FIG. 5).

The electric wiring unit 27A is a conductive member made of a metal plate, which is electrically connected to the backup roller 27 via a metallic bearing that rotatably supports the backup roller 27. The electric wiring unit 27A is electrically connected with a first terminal 27B which is provided at an end, in a width direction, of the frame 13D. Here, the width direction is a direction parallel with the axial direction of the driving roller 13B. According to the embodiment, the width direction (i.e., the axial direction of the driving roller 13B) is identical to the right-and-left direction indicated in the drawings. Thus, according to the embodiment, the first terminal 27B is provided at a right end of the frame 13D.

On the right end side of the frame 13D, in addition to the first terminal 27B, electricity feeding terminals 15A used for applying electric power to the transfer rollers 15 are provided. The electricity feeding terminals 15A and the first terminal 27B are connected to the electric substrate 29 via terminal unit 29A provided to the main frame 3A. The backup roller 27 is grounded via a common (earth) circuit 29D (see FIG. 6) of the electric substrate 29.

On the left side of the frame 13D, provided is a second terminal 13G which is connected to an electric wiring unit 13E which is connected to the discharging member 13F that discharges the driving roller 13B, driven roller 13C and transfer belt 13A. The second terminal 13G is electrically connected with the electric substrate 29C via the terminal unit 29B provided to the main frame 3A. The driving roller 13B etc. are grounded via the electric substrate 29C.

The terminal unit 29A is provided to the main frame 3A which faces the right end of the frame 13D, and the terminal unit 29B is provided to the main frame 3A which faces the left end of the frame 13D.

Therefore, according to the embodiment, the electric wiring unit 27A electrically connected to the backup roller 27 is an independent unit, independent from the other electric wiring unit 13E, and independently provided to the belt unit 13.

Figure 6:
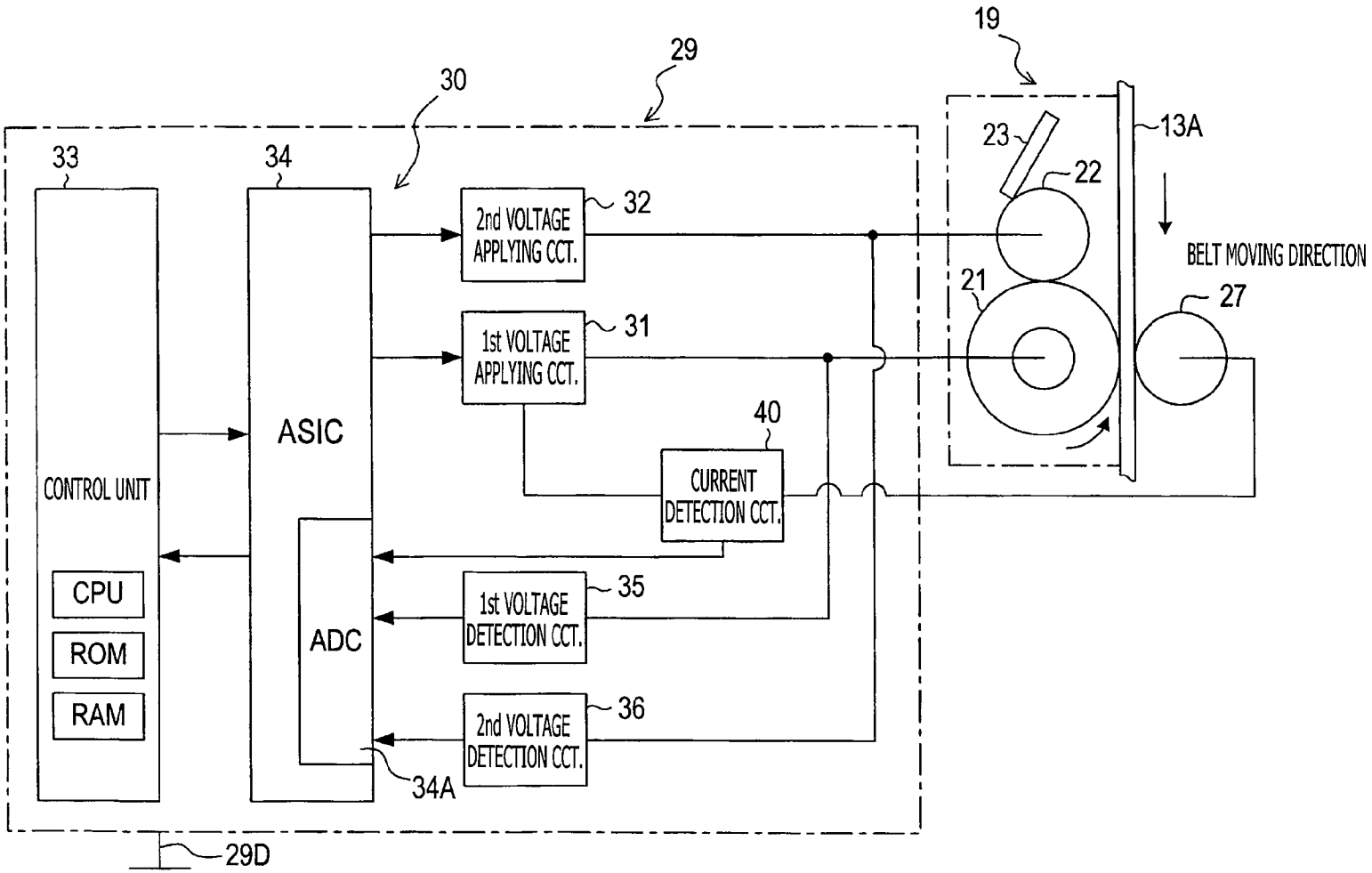
FIG. 6 is a block diagram schematically showing an apply voltage control circuit of the image formation device shown in FIG. 1.

The apply voltage control circuit 30 which applies a voltage to the belt cleaner 20 (i.e., the cleaning roller 21 and the cleaning shaft 22) has a first voltage applying circuit 31, a second voltage applying circuit 32 and a control unit 33, as shown in FIG. 6.

The first voltage applying circuit 31 applies a voltage to the cleaning roller 21 so that a predetermined electric potential is generated on the cleaning roller 21, and the second voltage applying circuit 32 applies a voltage to the cleaning shaft 22 so that a predetermined electric potential is generated on the cleaning shaft 22.

The control unit 33 controls the first voltage applying circuit 31 and the second voltage applying circuit 32. The control unit 33 is composed of a well-known micro computer and having a CPU, a ROM and a RAM.

Incidentally, according to the embodiment, the control unit 33 controls, via an integrated circuit for drive control such as an ASIC (application specific integrated circuit) 34 and the like, the first voltage applying circuit 31, the second voltage applying circuit 32 with use of a PWM (pulse width modulation).

A first voltage detection circuit 35 detects a voltage (electric potential) applied to the cleaning roller 21, and a second voltage detection circuit 36 detects a voltage (electric potential) applied to the cleaning shaft 22.

An electric current detection circuit 40 is connected to the electric wiring unit 27A via the terminal unit 29A and the first terminal 27B, and detects the amount of the electrical value flowing through the electric wiring unit 27A (i.e., the current value of the electric current flowing through the backup roller 27 and the cleaning roller 21).

The voltages detected by the first voltage detection circuit 35 and the second voltage detection circuit 36, and the detection signal output by the current detection circuit 40 are input to the control unit 33 via an A/D (analog-to-digital) converter 34A implemented in the ASIC 34. The control unit 33 detects the electric current flowing between the backup roller 27 and the cleaning roller 21 based on the signal output by the electric current detection circuit 40.

The pair of main frames 3A face each other with the belt unit 13 located therebetween. The electric substrate 29 which is implemented with the apply voltage control unit 30 is assembled to one of the pair of main frames 3A facing the first terminal 27B, on a surface opposite to the surface facing the first terminal 27B. On the electric substrate 29, the voltage control circuit that controls the applying voltages to the image formation unit 5, that is, the transfer rollers 15, the charger 7B and the like are also implemented.

The belt cleaner 20 collects the developer adhered to the transfer belt 13A with the electrostatic attractive force. Therefore, if the impedance of the transfer belt 13A is lessened due to change across age or deterioration of the transfer belt 13A, it becomes easier that relatively strong discharge (excess current) occurs between the cleaning roller 21 and the transfer belt 13A. If the strong discharge occurs frequently between the cleaning roller 21 and the transfer belt 13A, deterioration of the transfer belt 13A and the cleaning roller 21 proceed significantly.

According to the embodiment, the current value of the electric current flowing between the cleaning roller 21 and the transfer belt 13A, that is the electric current flowing through the electric wiring unit 27A is detected, and when the absolute value of the detected electric current (hereinafter, referred to as detected current value) becomes equal to or greater than a predetermined value, the first voltage applying circuit 31 is controlled so that the detected current value is smaller than the value detected to be greater than the predetermined value.

It should be noted that the predetermined value mentioned above is the current value when the strong discharge would occur between the cleaning roller 21 and the transfer belt 13A, and is generally determined by experiment or the like.

According to the embodiment, the electric wiring unit 27A, which is electrically connected to the backup roller 27, is an independent unit and does not share any portion with other unit (e.g., the electric wiring unit 13E) provided to the belt unit 13.

Because of the above-described configuration, the detected value of the electric current flowing through the electric wiring unit 27A, which is connected to the backup roller 27, is not affected by other electric current flowing through the electric wiring unit 13E. Therefore, the value of the electric current flowing through the electric wiring unit 27A can be detected accurately.

Since the excess current such as the discharge can be suppressed, it becomes possible to prevent the transfer belt 13A from deteriorated earlier, which enables a stable image formation over a relatively long period.

Further, according to the embodiment, the current detection circuit 40 is integrated with the first voltage applying circuit 31 which applies a voltage between the cleaning roller 21 and the backup roller 27, to constitute the apply voltage control circuit 30.

With the above configuration, in comparison with a case where the current detection circuit 40 and the first voltage applying circuit 31 are separate circuits, an electric system can be made simpler and the manufacturing cost can be reduced.

According to the embodiment, the first terminal 27B for the backup roller 27 is arranged between the electricity feeding terminals 15A as shown in FIG. 5. With this structure, electrical connections from the first terminal 27B and electricity feeding terminals 15A to the main body (electric substrate 29) can be made simple.

In the exemplary embodiment, the backup roller (the electric wiring unit 27A) is grounded. However, the invention needs not be limited to this configuration. For example, if the developer is negatively charged, the cleaning roller 21 or the cleaning shaft 22 may be grounded.

Various methods can be employed for detecting the current value of the electric current flowing through the electric wiring unit 27A if the current value is finally obtained. That is, a method of directly detecting the current value, a method indirectly obtaining the current value based on a voltage value, a method of obtaining the current value based on variation of magnetic field or electric field may be employed.

In the exemplary embodiment, the direct transfer method of transferring the developer directly on the sheet fed by the transfer belt 13A is employed. However, the invention needs not employ such a method, and an indirect method of transferring the developer on the transfer belt 13A and then transferring the developer from the transfer belt 13A to the sheet may be employed.

In the exemplary embodiment, the driving roller 13B etc. is grounded via the electric substrate 29C. However, the invention needs not be limited to this configuration and the driving roller 13B etc. may be directly grounded, not via the electric substrate 29C.

In the exemplary embodiment, rollers such as the cleaning roller and the backup rollers are used. However, the invention needs not be limited to such a configuration, and non-rotatable members such as brush or blade may be used instead of the rollers.

Further, various modifications can be made without departing from the scopes of the invention, which are described in the claims.

What is claimed is:

1. An image formation device configured to form images on a recording sheet in accordance with an electrophotographic image formation process, comprising:

a belt unit having an endless belt wound around a first roller and a second roller;

a cleaning unit facing the endless belt and configured to collect particles adhered on the endless belt with use of an electrostatic attractive force, a first voltage being applied to the cleaning unit;

a backup unit arranged to face the cleaning unit with the endless belt being located therebetween, a second voltage that is different from the first voltage being applied to the backup unit;

an electric wiring unit provided to the belt unit and electrically connected with the backup unit; and an electric current detection unit configured to detect a current value of an electric current flowing through the electric wiring unit, wherein the electric wiring unit is electrically independent from other electric wiring units provided to the belt unit.

2. The image formation device according to claim 1, wherein the current detection unit is integrated with a voltage applying control unit that applies a voltage between the cleaning unit and the backup unit.

3. The image formation device according to claim 1, wherein a first terminal unit electrically connected with the electric wiring unit is provided on one end side of the belt unit in a width direction which is an axial direction of the first roller, and wherein a second terminal unit electrically connected with the other electric wiring unit is provided on another end side of the belt unit in the width direction.

4. The image formation device according to claim 3, wherein the belt unit has a frame structure that supports the first roller and the second roller, and detachably attached to a main body of the image formation device, wherein the first terminal unit to be connected with the electric wiring unit is provided at one end side, in the width direction, of the frame structure, and wherein the second terminal unit to be connected with the other electric wiring unit is provided at another end side, in the width direction, of the frame structure.

5. The image formation device according to claim 4, wherein an electric substrate implemented with the electric current detection unit is arranged at a position facing the first terminal unit in a direction parallel with the axial direction of the first roller.

6. The image formation device according to claim 3, wherein a plurality of transfer units are arranged within a space surrounded by the endless belt, wherein third terminal units electrically connected to the plurality of transfer units are arranged in a moving direction of the endless belt, and wherein the first terminal unit is arranged between the third terminal units.

7. The image formation device according to claim 1, wherein the backup unit includes a rotating roller contacting the endless belt.

* * * * *